United States Patent [19]

Hodgens

[11] Patent Number: 4,999,948

[45] Date of Patent: Mar. 19, 1991

[54] SCREEN ASSEMBLY

[75] Inventor: Howard S. Hodgens, Burwood, Australia

[73] Assignee: Altasol Nominees Pty. Ltd., Burwood, Australia

[21] Appl. No.: 432,524

[22] Filed: Nov. 6, 1989

[30] Foreign Application Priority Data

Nov. 7, 1988 [AU] Australia ..... PJ1344

[51] Int. Cl.[5] ..... E05F 17/00

[52] U.S. Cl. ..... 49/74; 49/86; 49/89

[58] Field of Search ..... 49/74, 83, 86, 89; 160/166.1, 107, 230, 176.1, 177; 98/121.2

[56] References Cited

U.S. PATENT DOCUMENTS

| | | | |
|---|---|---|---|
| 369,484 | 9/1887 | Urich | 49/74 |
| 1,876,850 | 9/1932 | Burgess | 49/89 X |
| 1,919,677 | 7/1933 | Young | 160/236 U X |
| 2,165,669 | 7/1939 | Wade | 49/86 X |
| 2,520,273 | 8/1950 | Bopp et al. | 49/86 X |
| 2,733,486 | 2/1956 | Peeples | 49/83 |
| 2,758,345 | 8/1956 | White | 49/86 X |
| 3,211,264 | 10/1965 | Streeter, Jr. | 49/89 X |
| 3,741,102 | 6/1973 | Kaiser | 49/74 X |
| 4,449,563 | 5/1984 | Toda et al. | 49/74 X |
| 4,818,590 | 4/1989 | Prince et al. | 160/236 |

FOREIGN PATENT DOCUMENTS

| | | | |
|---|---|---|---|
| 5015 | 11/1932 | Australia | 49/74 |
| 284152 | 8/1965 | Australia | 49/74 |

*Primary Examiner*—Philip C. Kannan

*Attorney, Agent, or Firm*—Barnes, Kisselle, Raisch, Choate, Whittemore & Hulbert

[57] ABSTRACT

A louvre screen or blind comprising a number of blades located in side by side parallel relationship extending between two spaced apart framework members. The louvre blades are mounted so as to be capable of pivoting about their respective lengthwise extending axes by a fixed fastening means at their collective one ends and fastening means with selectively adjustable tension at the collective other ends. The selectively adjustable tension fastening means and the fixed fastening means co-operating to maintain the blades in tension so that the blades are capable of resisting deformation of the blades from their parallel position in use.

23 Claims, 4 Drawing Sheets

SCREEN ASSEMBLY

The present invention relates to screens in general and to movable louvre screens or blinds in particular. Even more so, the present invention relates to pivotal louvre solar screens which are capable of being assembled together so as to define quite long lengths of the screen or blinds. More particularly, the present invention relates to blind or screen assemblies comprising a set of blades or louvres arranged in parallel formation and each rotatable about its lengthwise extending axis; the vertical venetian blind or vertical louvre blind being a common example of such an assembly. A particularly preferred form of the invention relates to so-called mini-louvre blinds.

Although the present invention will be described with particular reference to solar screens having a plurality of pivotal blades or louvres of very small width capable of being assembled together to define a screen or blind, it is to be noted that the present invention is not limited to the described arrangement but many other arrangements which are not specifically illustrated fall within the scope of the present invention. Furthermore, the scope of the present invention may be extended to include other applications for the screens and to other arrangements of the screens.

Blind assemblies of the type to which the present invention relates can be fitted to windows, skylights, and the like or can be provided as room dividers. The assemblies may be used either externally or internally. When fitted externally they can provide very efficient control for the amount of light passing through them such as for full shading from solar heat when in a closed configuration and permitting light transmission when in an opened configuration either fully or partially opened. Thus, the amount of admitted light can be controlled by adjusting the position adopted by the louvres or blades.

One problem with existing louvre blinds is that when in the fully opened position a substantial proportion of the available area remains shielded or shaded so that the maximum amount of transmission of light and heat is reduced according to the amount of area shaded by the blades or louvres. This problem is particularly apparent with relatively wide louvres or thick louvres. This problem may be overcome by having very thin and narrow louvres. Thin louvres of very narrow widths when in the fully opened position are virtually invisible and when in this position reduce the amount of incident radiation passing through them only marginally from the maximum, which is to say such louvres shade the minimum of area and thus these mini-louvres are very efficient. However, such mini-louvres because of their relatively light-weight construction are susceptible to disturbances caused by wind and the like. In some circumstances, such as in winds of high velocity, the mini-louvres may even be damaged by being permanently bent or the like or dislodged from their mountings or fastenings. Therefore, there is a need to provide louvres having a relatively thin width but which are strong in themselves and which are strongly attached to their supports. Thus, it is an aim of the present invention to provide a screen or blind of mini-louvres which are nevertheless strong and securely fastened under tension.

According to one aspect of the present invention there is provided a louvre screen assembly comprising a plurality of substantially parallel spaced apart blades interconnected together by at least one interconnection means for operation in unison wherein each blade is secured to a first framework member at one end by a fixed fastening element and to a second frame work member at the other end by an adjustable or resiliently mounted fastening element such that the blade is free to pivot about its lengthwise extending axis in response to corresponding movement of the interconnection means and is maintained under a predetermined tension in the lengthwise extending direction to resist deformation from its parallel position.

According to another aspect of the present invention there is provided a louvre screen assembly comprising a first framework member, a second framework member, a plurality of elongate blades extending between the first and second framework members in parallel relationship to each other, said first and second framework members being parallel to each other and substantially perpendicular to the lengthwise extending axes of the blades, an interconnection element interconnecting each of the plurality of blades for operation of the blades in unison, a control means for operating movement of the interconnection element to pivot the blades about their respective longitudinal axes in unison wherein each blade is anchored to one of the framework members by a fastening means which applies a preselected tension to the blade in the lengthwise extending direction to retain the blade under tension in use.

Typically, the plurality of blades define a louvre blind or screen that is pivotally adjustable between a fully opened position in which the edges of adjacent blades are spaced apart from each other and a fully closed position in which the edges of adjacent blades partially overlap.

Typically, the blades are made of metal, preferably stainless steel. However the blades may be made from any suitable material such as aluminium, plastics or the like and may have any suitable finish applied to them. One form of the blades is typically of a sandwich construction in which there are two metal outer layers on either side of a rubber intermediate layer. The metal layers are bonded to the rubber layer by suitable adhesives. Typically, the blades may be centrally pivoted or be pivoted off-center by being centrally or off-centrally fastened to their supports.

Typically, the interconnection means is a wire or a thin strip of metal. The wire is typically wound around in a helical arrangement and is provided with apertures at regularly spaced apart locations along its length. The thin metal strip is essentially circular in cross-section and is provided with a number of apertures at regularly spaced apart locations over its entire length. The apertures are formed in flattened sections of the wire. Typically, the interconnection means, whatever form it takes, is located behind the screens so that they are wholly or partially obscured by the blades. Typically, the blades are narrow and thin and are almost transparent when in the fully opened configuration yet overlap slightly when fully closed to be completely occluded. Typically, the blades are about 15 mm wide and located at 12–13 mm centers. Typically, the screen or blinds of the present invention are mounted externally of the window.

The present invention will now be described by way of example with reference to the following drawings in which.

Figures 1, 5, 6:
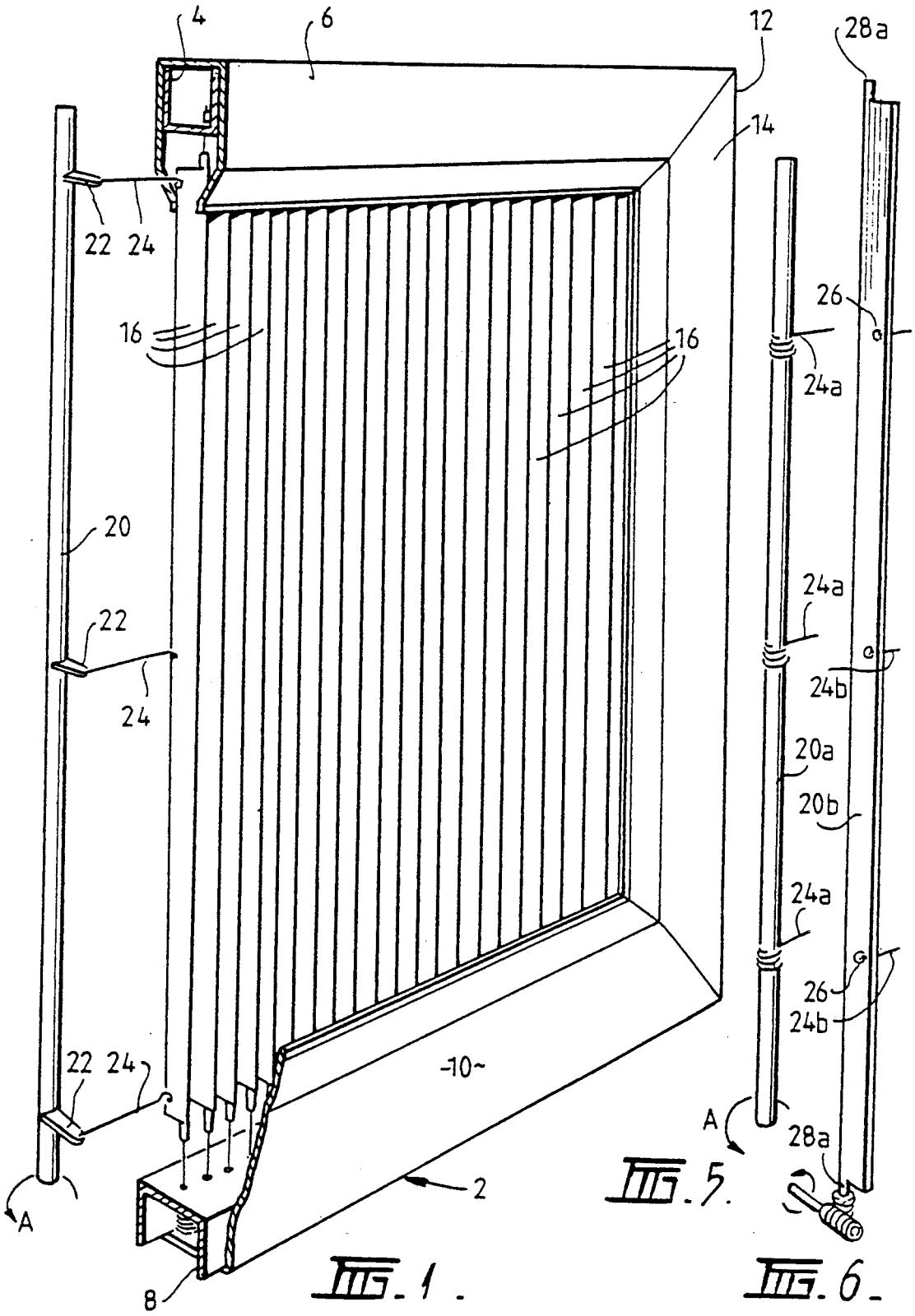
FIG. 1 is a perspective view of one form of the screen assembly of the present invention.
FIG. 5 is a perspective view of one form of the control means of the present invention.
FIG. 6 is a perspective view of another form of the control means the present invention.

In the drawings there is shown a screen, generally denoted as 2, comprising an upper framework member 4 covered by an upper fascia or cover strip 6, a lower framework member 8 covered by a lower fascia or cover strip 10, a side framework member 12 covered by a side cover strip 14 and a plurality of blades 16 arranged along the length of the framework members 4, 8 in a parallel formation to define a set of louvres. Although only one side framework member 12 and cover strip 14 is shown it is to be noted a similar arrangement exists on the other side. The other side arrangement has been omitted to show the working of one form of the control means. One form of the control means is a control rod. However, it is to be noted that it is possible to have other forms of the control means.

Control rod 20 is provided at one or at both ends of the screen assembly and is pivotally mounted to the framework members. Suitable means (not shown) are provided to control operation of control rod 20 so as to cause it to rotate about its longitudinal axis as indicated by arrow A. Tabs 22 are provided at regularly spaced apart locations along the length of control rod 20 to extend therefrom to receive the ends of cross-wires 24 which are secured thereto. Cross-wires 24 are but one form of the interconnecting means. Other forms of the interconnecting means fall within the scope of this invention. Although only 3 sets of tabs 22 and cross-wires 24 are shown it is to be noted that any number of tabs and control wires may be present depending on the height of the screen assembly. Each of the cross-wires 24 interconnects all of the plurality of blades so that movement of the cross-wires in response to movement of the control rod causes all of the blades to pivot in unison to effect opening or closing of the screen assembly either fully or partially as desired.

Alternative embodiments of control rod 20 are shown in FIGS. 5 and 6. In the embodiment of FIG. 5 control rod 20*a* has a number of apertures located at regularly spaced apart locations about its longitudinal axis for receiving the ends of cross-wires 24*a* therethrough. The ends of cross-wire 24*a* are wrapped around control rod 20*a* a number of turns to secure the cross-wires to the rod. In the embodiment illustrated in FIG. 6 the control rod has the form of a flat blade 20*b* being provided with a number of apertures located at more or less regularly spaced apart locations over the entire length of the blade for receiving the ends of cross-wires 24*b*. Ends of cross-wires 24*b* are securely fastened to the blade by suitable fastening means 26*b*, such as for example, ferrules, collets or the like. Flat blade 24*b* is provided with axles 28*a*, *b* located at either end for facilitating pivotal movement of that blade 24*b* when received in aligned apertures in upper and lower framework members 4, 8. Operation of that blade 24*b* may be effected by any suitable means.

Figure 2:
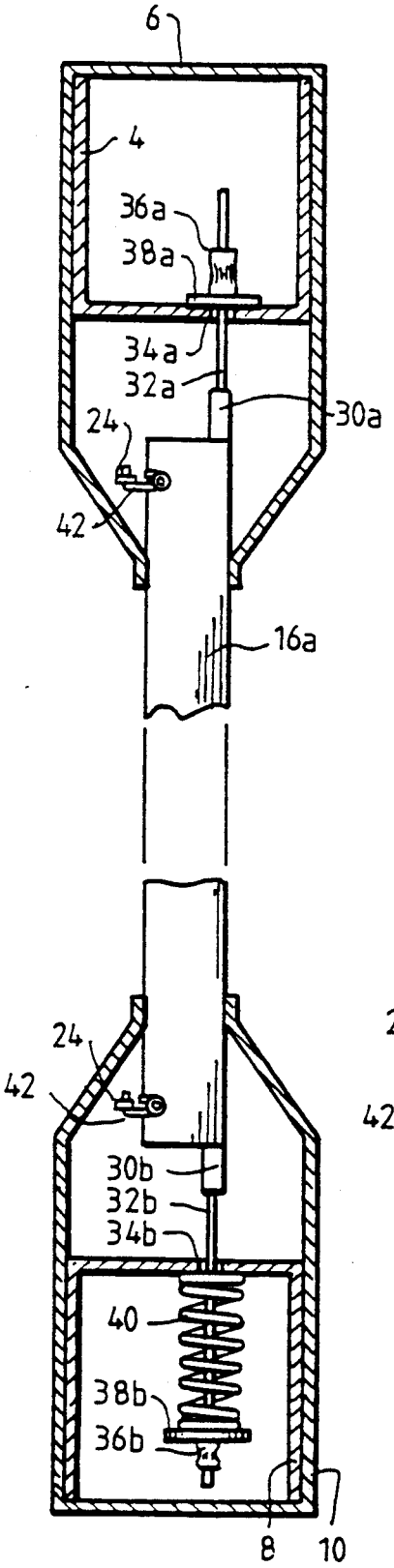
FIG. 2 is a vertical cross-section through one form of the screen assembly of the present invention.
Figure 3:
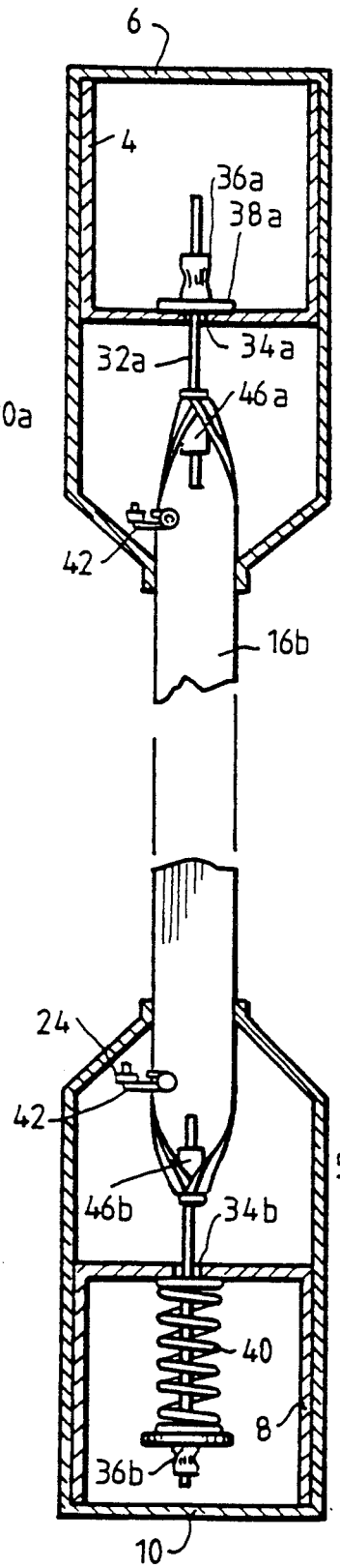
FIG. 3 is a vertical cross-section through another form of the screen assembly of the present invention.
Figure 4:
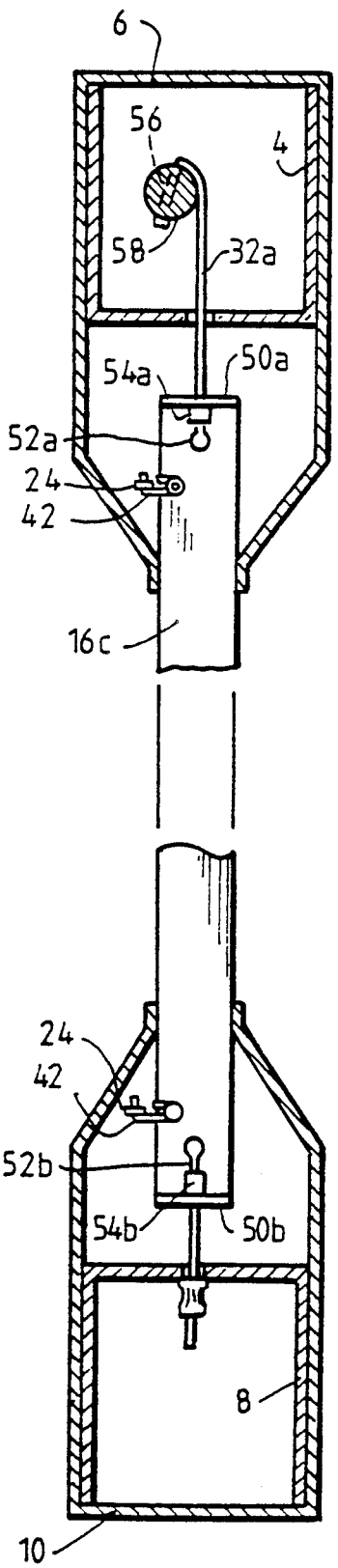
FIG. 4 is a vertical cross-section through another form of the screen assembly of the present invention.

The mounting of the blades forming the louvre screen will now be described in detail. Three embodiments of blade 16 are shown in FIGS. 2 to 4. In the embodiment of FIG. 2 blade 16*a* is provided at its upper and lower ends in use with integrally formed collars 30*a*, 30*b* respectively, collars 30*a*, 30*b* are each located offset from the central longitudinal axis to one side. Support wires 32*a*, 32*b* are securely fastened to collars 30*a*, 30*b* respectively. Upper support wire 32*a* is received through apertures 34*a* in the lower surface of upper framework member 4 to locate the upper end of blade 16*a* in place. Ferrule 36*a* and washer 38*a* are located over the end of support wire 32*a*; washer 38*a* providing a bearing surface and ferrule 36*a* being crimped to wire 32*a* in order to provide a fastener for the end of wire 32*a*. Thus, by means of ferrule 36*a* and washer 38*a*, wire 32*a* is securely anchored to upper framework member 4 thus allowing blade 16*a* to twist or rotate, and thereby providing a support pivot for blade 16*a*.

Support wire 32*b* is provided at the lower end of blade 16*a* and is attached thereto by the collar 30*b*. The other end of wire 32*b* after passing through aperture 34*b* in lower framework member 8 is provided with a helical compression spring 40 in addition to ferrule 36*b* and washer 38*b*. Helical compression spring 40 is retained in a more or less compressed state. Thus, blade 16*a* is maintained under tension between the upper end lower framework members at a preselected or predetermined tension in accordance with the strength of the helical compression spring 40. The tension applied by spring 40 may be adjusted by moving the position of ferrule 36*b* and accordingly washer 38*b* along the length of support wire 32*b*. Cross-wire retaining clip 42 is located at more or less regularly spaced apart locations along the length of blade 16 for interconnecting with cross-wire 24. Clip 42 may take any suitable or convenient form. Typical forms of clip 42 will be described in detail below. Other forms are possible.

Alternative forms of blades 16 are shown in FIGS. 3 and 4. The manner in which blade 16*b* of FIG. 3 is fastened to upper and lower framework members 4 and 6 is the same as that for embodiment 16*a*. However, blade 16*b* at both its upper end and lower end has its edges curled around so as to define a circular profile which envelopes ferrule 46*a*, 46*b* at its upper end and lower end respectively. The circular ends of the blade is crimped or otherwise frictionally fastened to the ferrules.

In the embodiment shown in FIG. 4 blade 16*c* is provided with flanges 50*a*, 50*b* located at either end. A keyhole slot 52*a*, 52*b* is provided at either end of blade 16*c* adjacent flanges 50*a*, 50*b*. Ferrule 54*a*, 54*b* which is provided at the ends of support wire 32*a*, 32*b* respectively is received through the circular openings of the keyhole slots and retained by the elongate slots of the keyhole slots 52*a*, 52*b* respectively. The lower end of support wire 32*b* is provided with a ferrule 36*b* and optionally a washer securely anchoring the wire in place.

The adjustable or resilient mounting of blade 16*c* is effected at the upper end of the blade where it is fixed to the upper framework member. The upper end of support wire 32*a* is received through a bore 56 transversely located through windlass 58 so that as windlass 58 rotates the tension applied to blade 16*c* may be adjusted. Windlass 58 is journalled within upper framework member 4 in any suitable or conventional manner.

Figure 7:
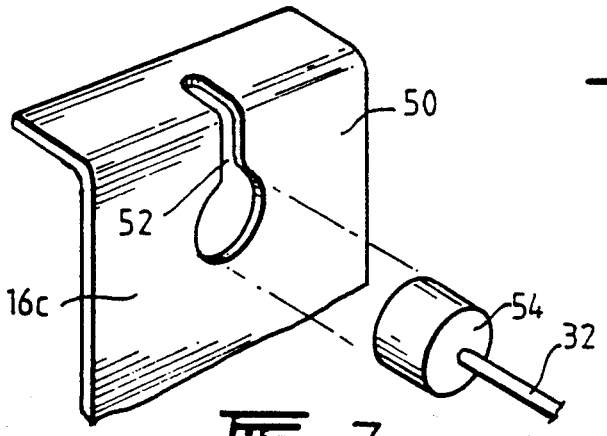
FIG. 7 is a perspective view of one end of one form of the louvre blade of the present invention.
Figure 8:
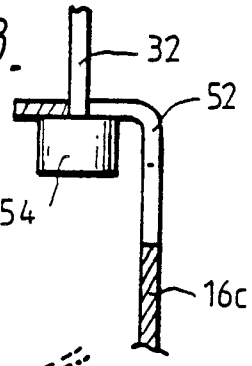
FIG. 8 is a cross-section of the embodiment of FIG. 7.

In FIGS. 7 and 8 are shown in more detail the arrangement of blade 16*c*, flange 50 and keyhole slot 52 and these features co-operate to secure the support wire and blade together. Ferrule 54 is inserted into the circular opening of keyhole 52 perpendicularly to the longitudinal plane of blade 16*c* and then moved through 90° whilst traversing the length of elongate slot 52 so as to be retained parallel to blade 16*c* in the in use position.

Figure 10:
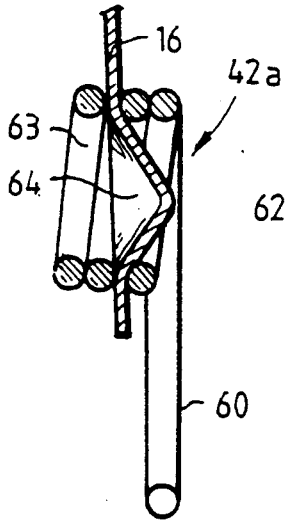
FIGS. 10 and 11 are each cross-sectional views of the clip of FIG. 9 showing two different forms of the blade.
Figure 11:
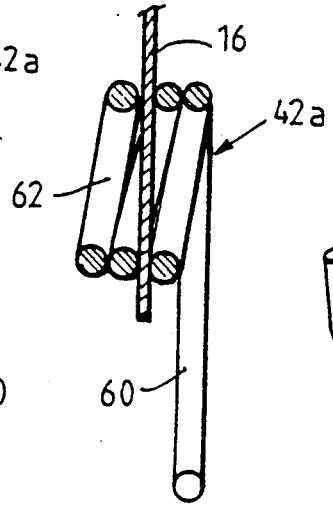
Figure 9:
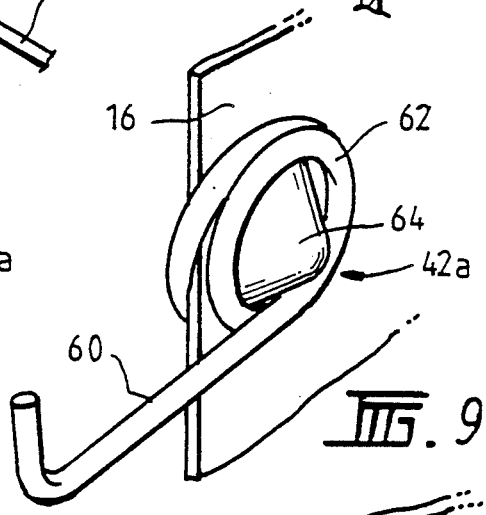
FIG. 9 is a perspective view of one form of the clip of the present invention.

In FIGS. 9, 10 and 11, one form of retaining clip 42 is shown which is denoted as 42*a*. Retaining clip 42*a* comprises a hook portion 60 and a helical or spiral spring attachment portion 62. Hook portion 60 extends outwardly from the edge of blade 16 in use whereas spring portion 62 is arranged to straddle the edge of blade 16 by the edge of blade 16 being located between adjacent turns of the spring portion 62. Spring portion 62 may be retained in place by compression as in the embodiment shown in FIG. 11 where blade 16 is squeezed between adjacent turns of the spring portion or it may be held in place by indentation 64 provided at a suitable location along the edge of blade 16 as shown in FIGS. 9 and 10. Indentation 64 is surrounded by the circumference of the turns of spring portion 62 and thus serves to locate clip 42*a*.

Figure 12:
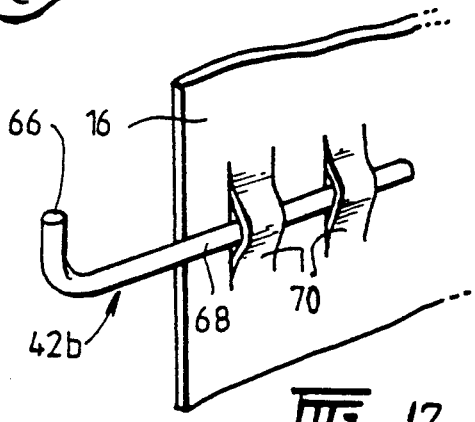
FIG. 12 is a perspective view of a further form of the clip and a further form of the blade.

An alternative form of retaining clip 42 is shown in FIG. 12 as clip 42*b*. Clip 42*b* consists of hook portion 66 and shank portion 68. Hook 66 extends beyond the edge of blade 16 so as to engage with the apertures of cross-wire 42 whereas shank 68 is received through an aligned pair of punchings or cut-outs 70. Punchings 70 are each punched out of blade 16 to define a spaced apart pair of retaining means that can be clamped or crimped around shank 68 in use to hold the retaining clip in place.

Figure 13:
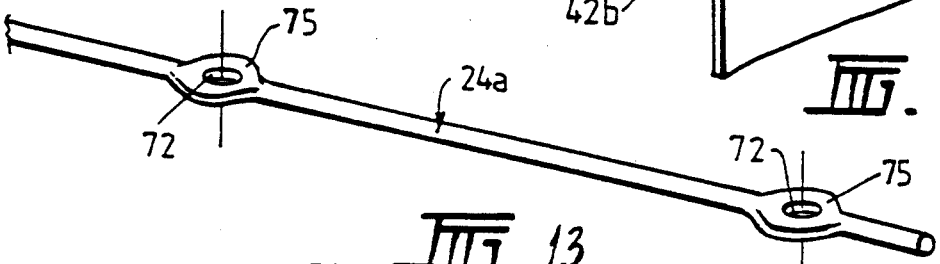
FIGS. 13 and 14 are perspective views of two different forms of the interconnection means of the present invention.
Figure 14:
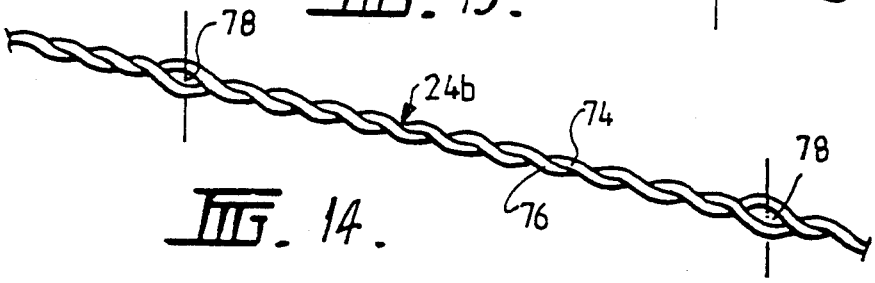

In FIGS. 13 and 14 are shown two forms of cross-wire 24. Cross-wire 24*a* of FIG. 13 comprises an elongate wire having apertures 72 located at regularly spaced apart locations along its entire length. The spacing of apertures 72 corresponds to the spacing of the hook portion of clips 42 when clips 42 are secured to the edges of blades 16 since in use the hook portions of clips 42 are received in apertures 72 so that as cross-wire 24 moves blades 16 are caused to pivot in unison. Cross-wire 24 is circular or rounded in cross-section. The apertures 72 spaced along wire 24*a* are surrounded by a flattened portion 75.

An alternative form of cross-wire 24, denoted as 24*b*, is shown in FIG. 14. Cross-wire 24*b* comprises a pair of identical wires 74, 76 twisted or otherwise braided together over their length. Every so often at regularly spaced apart locations an aperture 78 is formed in the wire by wires 74, 76 being slightly spaced apart from each other rather than being twisted tightly together. The hook portion of clips 42 is received in aperture 78 so that blades 16 may move in unison in response to corresponding movement of cross-wire 24.

Figure 15:
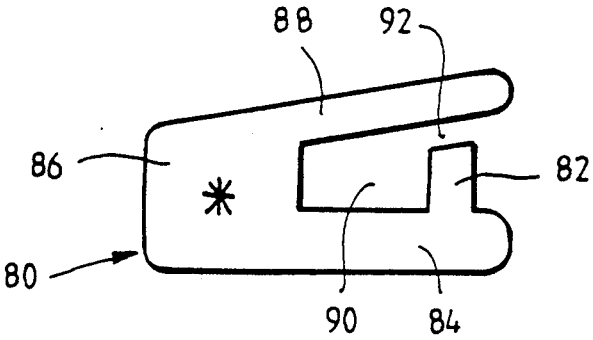
FIG. 15 is a side elevation view of a still further embodiment o clip of the present invention.

In FIG. 15 there is shown a further embodiment of retaining clip 42. This embodiment which is denoted as 80 is used for connecting the louvre or blade to the cross-wire. Clip 80 is formed from a thin section of metal and is thus substantially flat. Clip 80 comprises four peripheral arm portions 82, 84, 86, 88 arranged with respect to each other in the form of a generally open sided quadrilateral shape defining square aperture 90 therebetween. Arm portion 88 is in one configuration angularly inclined to the remaining arm portions which are more or less substantially inclined at about 90° to each other to define a gap 92 between the ends of arm portions 88 and 82. The cross-wire or similar is inserted into the square aperture 90 through gap 92 in use. Then, arm 88 is crimped or otherwise moved to close gap 92 to securely fasten the central wire to clip 80. Clip 80 is spot welded to the edge of the louvre in the vicinity of area of arm 86 as marked by * in FIG. 15.

Figure 16:
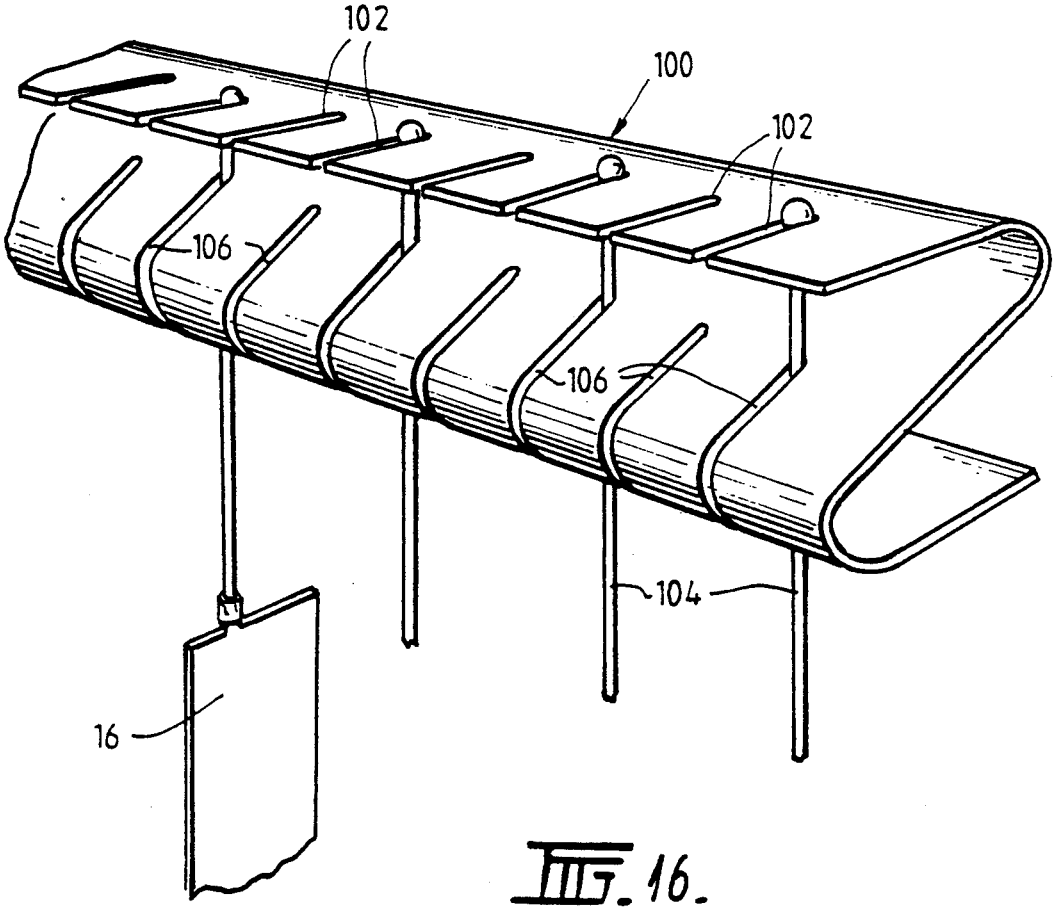
FIG. 16 is a perspective view of a further embodiment for fastening the louvres under tension in the assemblies.

In FIG. 16, there is shown a sinusoidal spring 100 which is an alternative means of the adjustable or resilient fixing means maintaining the louvres under tension. Sinusoidal spring 100 is provided with a plurality of spaced apart parallel slots 102 along one edge for receiving the ends of a first set of support wires 104 connected to the louvres. A second row of a plurality of slots 106 are located at regularly spaced apart intervals along the lower curve of spring 100 to receive a second set of support wires 104. Spring 100 is securely located in the framework support, typically the upper framework support, of the assembly in a suitable or conventional manner.

The described arrangement has been advanced by way of explanation and many modifications may be made thereto without departing from the spirit and scope of the invention which includes every novel feature and novel combination of features hereindisclosed.

Those skilled in the art will appreciate that the invention described herein is susceptible to variations and modifications other than those specifically described. It is understood that the invention includes all such variations and modifications which fall within its spirit and scope.

I claim:

1. A louvre screen assembly comprising a plurality of substantially parallel spaced apart blades interconnected together by at least one interconnecting means for controlling operation of the blades in unison wherein one end of each of the plurality of blades is secured to a first framework member by a fixed fastening element and at the other end to a second framework member by an adjustable or resiliently mounted fastening element so that when the blade is located intermediate the respective fastening elements the blade is free to pivot about its lengthwise extending axis in response to corresponding movement of the interconnection means, each of said blades being maintained under a predetermined tension in its lengthwise extending direction due to tension provided by said adjustment or resilient mounted fastening element so as to resist unwanted deformation from its parallel position whilst allowing pivotal movement, at least one of each blade being curled over upon itself in order to define a substantially circular aperture and a collar being located in said aperture to receive a support wire, said support wire being clamped to secure the end of the blade.

2. A louvre screen assembly comprising a plurality of substantially parallel spaced apart blades interconnected together by at least one interconnection means for controlling operation of the blades in unison wherein one end of each of the plurality of blades is secured to a first framework member by a fixed fastening element and at the other end to a second framework member by an adjustable or resiliently mounted fastening element so that when the blade is located intermediate the respective fastening elements the blade is free to pivot about its lengthwise extending axis in response to corresponding movement of the interconnection means, each of said blades being maintained under a predetermined tension in its lengthwise extending direction due to tension provided by said adjustment or resilient mounted fastening element so as to resist unwanted deformation from its parallel position whilst allowing pivotal movement, one end of each blade being provided with a flange and a keyhole slot at or near the flange, said keyhole slot being adapted to receive a support wire therethrough, said wire being provided with a retaining means to secure the end of the blade.

3. A louvre screen assembly comprising a plurality of substantially parallel spaced apart blades interconnected together by at least one interconnection means for controlling operation of the blades in unison wherein one end of each of the plurality of blades is secured to a first framework member by a fixed fastening element and at the other end to a second framework member by an adjustable or resiliently mounted fastening element so that when the blade is located intermediate the respective fastening elements the blade is free to pivot about its lengthwise extending axis in response to corresponding movement of the interconnection means, each of said blades being maintained under a predetermined tension in its lengthwise extending direction due to tension provided by said adjustment or resilient mounted fastening element so as to resist unwanted deformation from its parallel position whilst allowing pivotal movement, each of the connection means being a cross-wire or thin strip of metal, each wire or metal strip having a plurality of apertures located at regularly spaced apart intervals over its entire length, each blade being provided with a retaining clip for connecting the blade to the interconnecting element for permitting movement of the blades in unison in response to movement of the interconnecting means, said retaining clip comprising a hooklike projection located at its distal end for engaging one of the apertures provided in the interconnecting element and an attachment means located at its proximal end facilitating attachment of the clip to the blade, said attachment means being a helical or spiral spring means in which a first portion of the spring means is located on one side of the blade and a second portion of the spring means is located on the other side of the blade so that the spring means staddles and frictionally engages the blade.

4. A louvre screen assembly according to claim 3 in which the spacings of the apertures, of the interconnecting means is such so as to permit the hook portions of the retaining clips to be received through the apertures to allow operation of the blades in unison in response to movement of the interconnecting element.

5. A louvre screen assembly adapted for use for mounting externally in a window or similar opening for controlling the amount of solar radiation being transmitted through the window or opening comprising a plurality of substantially parallel spaced apart lightweight blades forming a louvre arrangement, said blades being interconnected together by at least one lightweight interconnection means for controlling operation of the blades in unison between a fully opened position for admitting a substantially absolute maximum amount of radiation and a fully closed position, said interconnection means being arranged to extend substantially transversely of said blades, each of said lightweight blades being of the very thin louvre type having a thickness very much less than its width so that when in the fully opened position, the blades are substantially invisible when viewed directly side on, first and second framework members being arranged substantially transversely to the axes of the plurality of blades, a plurality of fixed fastening elements, a plurality of adjustable or resiliently mounted fastening elements, said blades being arranged so that one end of each of the plurality of blades is pivotally secured to said first framework member by a fixed fastening element for securely anchoring the blade in position and the other end of each blade is pivotally secured to said second framework member by said adjustable or resiliently mounted fastening element for applying a preselected tension to the blade, said blades when located in position between the first and second framework members being free to pivot about their lengthwise extending axes in unison in response to corresponding movement of the interconnection means, said blades being mounted in position under tension in use so as to be able to resist unwanted deflection or deformation from their substantially parallel position in use during periods of high wind loading, wherein said adjustable or resiliently mounted fastening element includes a spring means and a support wire wherein one end of the support wire is fixedly connected to the blade and the other end of the support wire is releasably connected to the spring means.

6. A louvre screen assembly according to claim 5 in which when the plurality of blades are in the fully opened position the edges of adjacent blades are spaced apart from each other and when in the fully closed position the edges of adjacent blades partially overlap.

7. A louvre screen assembly according to claim 5 in which the blades are made of metal.

8. A louvre screen assembly according to claim 7 in which the metal is stainless steel or aluminum.

9. A louvre screen assembly according to claim 5 in which each of the blades is centrally pivoted along its longitudinal central axis.

10. A louvre screen assembly according to claim 5 in which each of the blades is pivoted off-center towards one side edge of the blade.

11. A louvre screen assembly according to claim 5 in which there is a plurality of similar interconnection means located at spaced apart locations at intervals along the longitudinal length of the blades.

12. A louvre screen assembly according to claim 11 in which each of the plurality of interconnection means has a plurality of attachment means located at regularly spaced apart intervals over its entire length, each attachment means connected to one blade for operating the blades in use.

13. A louvre screen assembly according to claim 5 in which the interconnection means is a cross wire or thin strip of metal.

14. A louvre screen assembly according to claim 13 in which the cross wire is formed from at least two wires wound around each other in a helical arrangement having a twisted or braided appearance.

15. A louvre screen assembly according to claim 14 in which the attachment means is an aperture.

16. A louvre screen assembly according to claim 15 in which the fixed fastening means is a collar formed integrally with one end of the blade and a support wire extending from the collar, said first framework member having an aperture located therein for receiving one end of the support wire, wherein said support wire, after passing through the aperture, is retained in place by a ferrule frictionally clamped about the support wire thereby securely maintaining the end of the blade in position.

17. A louvre screen assembly according to claim 5 in which the spring means of the adjustable or resiliently mounted fastening means comprises a sinusoidally shaped spring having one or more slots.

18. A louvre screen assembly according to claim 5 in which at least one end of the blade is curled over upon itself in order to define a substantially circular aperture having a collar located therein to receive a support wire, said collar clamping said support wire for securing the end of the blade in place.

19. A louvre screen assembly according to claim 5 in which one end of the blade is provided with a flange and a keyhole slot in, at or near the flange, said keyhole slot being adapted to receive a support wire therethrough, said support wire being provided with a retaining means to secure the end of the blade.

20. A louvre screen assembly according to claim 5 wherein each blade is provided with a retaining clip for connecting the blade to the interconnecting element, said interconnecting element being provided with a plurality of apertures, said retaining clip comprising a hook-like projection located at its distal end for engaging one of the apertures provided in the interconnecting element and an attachment means located at its proximal end to facilitate attachment of the clip to the blade.

21. A louvre screen assembly according to claim 20 in which the attachment means is a helical or spiral spring means in which a first portion of the spring means is located on one side of the blade and a second portion of the spring means is located on the other side of the blade so that the spring means straddles and fictionally engages the blade.

22. A louvre screen assembly according to claim 21 in which each of the plurality of blades is provided with an indentation means for additionally co-operating with the spring means of the retaining clip, to securely locate and hold the clip on the blade.

23. A louvre screen assembly according to claim 21 in which each of the blades is provided with a co-operating means in the form of one or more crimpable tabs for securely fastening the retaining clip to the blade.

* * * * *